US010675885B2

(12) United States Patent
Mueller et al.

(10) Patent No.: US 10,675,885 B2
(45) Date of Patent: Jun. 9, 2020

(54) DEVICE FOR PRINTING INK ONTO PRINTING MATERIAL

(71) Applicant: HEIDELBERGER DRUCKMASCHINEN AG, Heidelberg (DE)

(72) Inventors: Andreas Mueller, Heidelberg (DE); David Ehrbar, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/115,891

(22) Filed: Aug. 29, 2018

(65) Prior Publication Data

US 2019/0061366 A1 Feb. 28, 2019

(30) Foreign Application Priority Data

Aug. 29, 2017 (DE) ..... 10 2017 215 040

(51) Int. Cl.
*B41J 2/175* (2006.01)
*B41J 2/18* (2006.01)
*B41J 25/304* (2006.01)

(52) U.S. Cl.
CPC ..... *B41J 2/18* (2013.01); *B41J 2/175* (2013.01); *B41J 25/304* (2013.01); *B41J 2202/12* (2013.01)

(58) Field of Classification Search
CPC ... B41J 2/18; B41J 2/175; B41J 25/304; B41J 2202/12
See application file for complete search history.

(56) References Cited

U.S. PATENT DOCUMENTS 4,937,598 A 6/1990 Hine et al.
5,189,438 A 2/1993 Hine et al.
5,751,300 A 5/1998 Cowger et al.
(Continued)

FOREIGN PATENT DOCUMENTS

DE 69015519 T2 8/1995
DE 69523648 T2 5/2002
(Continued)

OTHER PUBLICATIONS

Google translation of JP 2008201023, published on Sep. 2008 (Year: 2008).*

*Primary Examiner* — Huan H Tran
(74) *Attorney, Agent, or Firm* — Laurence A. Greenberg; Werner H. Stemer; Ralph E. Locher

(57) ABSTRACT

A printing device includes an ink jet print head having individually controllable nozzles for jetting ink drops. An ink line connected to a chamber has a feed and/or return line for the print head. The print head, ink line and chamber move jointly relative to printing material. The ink line is part of a circulation ink supply system for the print head. A mass element associated with the chamber has a position and/or shape relative to the chamber changing as a function of the joint movement so that the chamber volume is a function of the position and/or shape of the mass element to compensate for pressure fluctuations and/or movements of the ink and avoid problems in the ink supply system for a print head in industrial, high-performance ink jet printing and in cooperation with circulation ink supply systems conveying large volumes of ink.

9 Claims, 2 Drawing Sheets

(56) References Cited

U.S. PATENT DOCUMENTS

| | | | | |
|---|---|---|---|---|
| 10,029,471 | B2 * | 7/2018 | Okubo | B41J 2/17563 |
| 2002/0047882 | A1 | 4/2002 | Karlinski et al. | |
| 2010/0225718 | A1 * | 9/2010 | Uezawa | B41J 2/17509 347/93 |
| 2013/0106963 | A1 | 5/2013 | Kawase et al. | |
| 2014/0118448 | A1 | 5/2014 | Domae | |
| 2017/0066246 | A1 | 3/2017 | Miyazawa | |
| 2017/0072722 | A1 | 3/2017 | Mueller et al. | |

FOREIGN PATENT DOCUMENTS

| | | | | |
|---|---|---|---|---|
| JP | 2008201023 | * | 9/2008 | B41J 2/045 |
| JP | 2008201023 | A | 9/2008 | |
| JP | 2015178212 | A | 10/2015 | |

* cited by examiner

DEVICE FOR PRINTING INK ONTO PRINTING MATERIAL

CROSS-REFERENCE TO RELATED APPLICATION

This application claims the priority, under 35 U.S.C. § 119, of German Patent Application DE 10 2017 215 040.8, filed Aug. 29, 2017; the prior application is herewith incorporated by reference in its entirety.

BACKGROUND OF THE INVENTION

Field of the Invention

The present invention relates to a device for printing ink onto a printing material, including an ink jet print head with a plurality of individually controllable ink nozzles for jetting ink drops, an ink line filled with ink and forming a feed line and/or a return line for the ink jet print head, and a chamber connected to the ink line, in which the ink jet print head, the ink line and the chamber are configured to carry out a joint movement relative to the printing material.

The technical field of the invention is the field of the graphic industry and in particular the field of industrial ink jet printing on flat substrates, i.e. the application of liquid ink to sheet-shaped or web-shaped printing materials, preferably made of paper, cardboard, or plastic.

In the known DOD (drop-on-demand) ink printing method, liquid ink is applied to a flat printing material to create a printed image by using an ink jet print head (referred to as a head for short) with individually controllable nozzles that generate tiny ink droplets, preferably in a picoliter range, and transfer them to the printing substrate as print dots in a touch-free way. The nozzles may be actuated by piezoelectric actuators.

The print heads in industrial ink jet printing machines are connected to an ink supply system of the machine. Such a system has a reservoir for every ink to be applied. In general, a pump conveys the ink from the reservoir through a line to the print head or a row of print heads (feed line). In most cases, industrial ink jet printing machines have an ink circulation system, i.e. ink that has not been used is conveyed back to the reservoir (return line), if necessary by an additional pump. The ink supply may additionally include a filter, a deaerator, and a temperature control device, as well as a sensor for measuring ink fluid pressure.

The printing material and the ink jet print head must not touch during the printing process, i.e. as they move relative to one another, because any contact will damage the highly sensitive nozzle surface of the head, which is usually made of silicon and is very delicate, similar to a computer chip. Thus, a minimum distance absolutely needs to be maintained between the nozzle surface and the printing material, i.e. the printing material surface facing the head. That distance may be compromised by a bent corner (known as a dog ear) of the printing material or a wave in the printing material. Thus, a monitoring device for instance including an optical sensor may be provided to recognize such potential defects and eliminate them, for instance by stopping the printing operation, ejecting the printing material, or dynamically lifting the head into a safe position. A lifting and relowering of the head may result in an undesired movement of the ink in the head or ink line or in undesired pressure fluctuations in the ink. As a consequence, ink may leak from the print head in an uncontrolled way or air may be sucked into the head.

Description of the Related Art

Japanese Publication JP 2015-178212 A discloses a device for printing ink onto a printing material. The device includes an ink jet print head and a reservoir connected to the former by a flexible ink line. All components are jointly disposed on a ("scanning") carriage capable of a reciprocating movement. The reservoir is disposed on the carriage so as to be movable in the scanning direction and constructed to reduce ink fluctuation in the ink fluid. Due to their low productivity, ink jet printing processes that rely on scanning are not used in an industrial context, i.e. when printed products are to be manufactured in bulk. In addition, ink jet printing processes that rely on scanning are usually not used in connection with circulation ink supply systems.

SUMMARY OF THE INVENTION

It is accordingly an object of the invention to provide a device for printing ink onto printing material, which overcomes the hereinafore-mentioned disadvantages of the heretofore-known devices of this general type and which in particular provides a way of avoiding problems in the supply of ink to an ink jet print head in industrial, i.e. high-performance ink jet printing and in cooperation with circulation ink supply systems that convey large volumes of ink.

With the foregoing and other objects in view there is provided, in accordance with the invention, a device for printing ink onto a printing material, which comprises an ink jet print head with a plurality of individually controllable ink nozzles for jetting ink drops, an ink line filled with ink and forming a feed line and/or a return line for the ink jet print head, a chamber connected to the ink line, the ink jet print head, the ink line and the chamber being configured to carry out a joint movement relative to the printing material, the ink line being part of a circulation ink supply system to supply ink to the ink jet print head, a mass element associated with the chamber, and the position and/or the shape of the mass element relative to the chamber being changeable or variable as a result of the joint movement and in such a way that the volume of the chamber depends on the position and/or the shape of the mass element to compensate for pressure fluctuations in the ink and/or to compensate for movements of the ink.

The invention advantageously provides a way of avoiding problems in the ink supply system for supplying ink to an ink jet print head in industrial, i.e. high-performance ink jet printing and in cooperation with circulation ink supply systems that convey large volumes of ink.

Due to its mass inertia, the mass element carries out a compensatory movement in terms of the joint movement of the ink jet print head, ink line, and chamber. As a result, a compensation for undesired pressure fluctuations in the ink and/or a compensation for undesired ink movements are advantageously achieved. Depending on the direction of the compensatory movement, the movement may increase or reduce the volume of the chamber. Potential pressure fluctuations in the ink and/or potential ink movements may be compensated for by the variable chamber volume. In this way, ink supply problems may be avoided. Even shocks to the print head do not cause the aforementioned problems if the device of the invention is provided.

The mass of the mass element is preferably 100 to 200 grams or less.

Another preferred development of the invention may be distinguished in that the mass element forms a movable wall of the chamber or a movable piston inside the chamber.

A further preferred development of the invention may be distinguished in that a lever is provided to connect the mass element to a movable wall of the chamber or to a movable piston in the chamber. The maximum volume of the chamber may be selected by a selection of the lever ratio.

An added preferred development of the invention may be distinguished in that a spring and a damper are associated with the piston or lever.

The movable wall, the movable piston, the lever, the spring and/or the damper may be miniature elements, for example in the form of a micro-mechanical device. The mechanical elements may in particular be integrated into the print head and/or may be created in the course of the production of the print head.

An additional preferred development of the invention may be distinguished in that the mass element forms a deformable membrane or is disposed on a deformable membrane with the deformable membrane forming a wall of the chamber.

Another preferred development of the invention may be distinguished in that the ink line includes two throttles, i.e. a feed line throttle and a return line throttle, which uncouple a section of the ink line upstream and downstream of the ink jet print head form the rest of the circulation ink supply system. An uncoupling reduces the ink volume in which pressure fluctuations and/or ink movements are compensated for by a movement of the mass element. The mass element may thus have smaller dimensions and may react in a more dynamic way.

A further preferred development of the invention may be distinguished in that the two throttles are adjustable. In this way, the uncoupled ink volume becomes adjustable. The adjustment may be made as a function of the expected joint movement, namely of the length and/or the dynamics thereof.

An added preferred development of the invention may be distinguished in that the ink line forms a feed line for a first ink jet print head and at least one further ink jet print head and that the chamber is connected to the ink line upstream of the first ink jet print head.

An additional preferred development of the invention may be distinguished in that the ink line forms a return line for a first ink jet print head and at least one further ink jet print head and that the chamber is connected to the ink line downstream of the last ink jet print head.

A concomitant preferred development of the invention may be distinguished in that the ink jet print head is always unmoved during a problem-free printing operation and only carries out the joint movement with the ink line and the chamber—in a direction substantially perpendicular to the surface of the printing material—if a problem occurs. The head (or heads) is (are) preferably stationary during the printing operation and only the printing material moves.

Other features which are considered as characteristic for the invention are set forth in the appended claims. The features of the invention, of further developments of the invention, and of the exemplary embodiments of the invention may be combined with one another to create advantageous further developments of the invention. In addition, further developments of the invention may include the individual features or combinations of features disclosed in the above section titled "Field of the Invention."

Although the invention is illustrated and described herein as embodied in a device for printing ink onto printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. The invention as well as preferred further developments thereof will be explained in more detail below with reference to the drawings and based on a preferred exemplary embodiment.

DETAILED DESCRIPTION OF THE INVENTION

Figure 1:
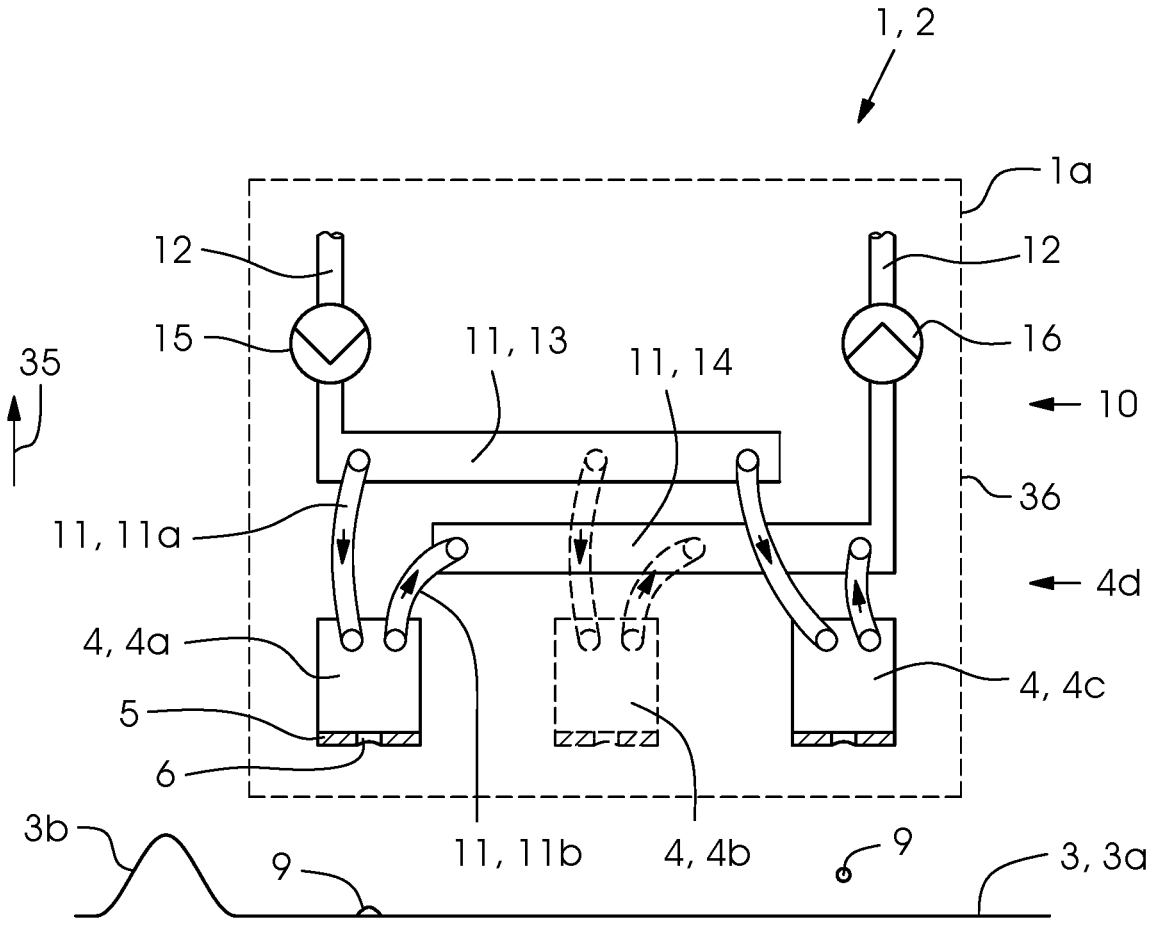
FIG. 1 is a diagrammatic, partly sectional view of a machine including a preferred exemplary embodiment of a device according to the invention.

Referring now in detail to the figures of the drawings, in which corresponding elements have the same reference symbols, and first, particularly, to FIG. 1 thereof, there is seen a device 1 according to the invention in a machine 2, for instance an industrial ink jet printing machine 2, that prints on a surface 3*a* of a printing material 3 made of paper, for instance. The printing material may have a defect 3*b* such as a crease or wave. In order to avoid any collision between this defect and an ink jet print head 4, the ink jet print head may carry out a controlled movement 35, e.g. an up and down movement.

The ink jet printing machine 2 may have multiple print heads 4*a* to 4*c* in a row or a print bar with a plurality of print heads. The invention will be explained by way of example with reference to the print head 4*a*.

The print head 4*a* includes a nozzle surface 5 with at least one ink nozzle 6, preferably a plurality of separately controllable nozzles for jetting ink 7 at an ink meniscus 8 and for generating an ink drop 9, which forms a print dot as it hits the paper. The meniscus is preferably maintained in the illustrated shape and position at all times, because otherwise ink might leak from the head in an uncontrolled way or air might be sucked in. The ink pressure that is required for this purpose is approximately −10 mbar. The ink pressure is preferably maintained at a substantially constant level by the invention.

The device 1 includes a circulation ink supply (ink circulation) system 10 including an ink line 11, a feed line 11*a* and a return line 11*b* for ink 12 as well as a feed line manifold 13, a return line manifold 14, a feed line pump 15, and a return line pump 16. The pumps are preferably controllable to maintain a substantially constant level of pressure in the ink line. The ink circulation system 10 further includes a non-illustrated ink reservoir. The ink volume in every manifold is approximately 100 to 200 ml, i.e. it has a weight of approximately 100 to 200 g.

The print head 4 (or heads 4*a* to 4*c*, 4*d*), the ink line 11 (or 11*a* and 11*b*) and a chamber 17 form an integrated unit 36, preferably having a common housing or a common mount. This unit may carry out the controlled, joint movement 35, for instance to avoid a defect or problem 3*b*.

Figure 2:
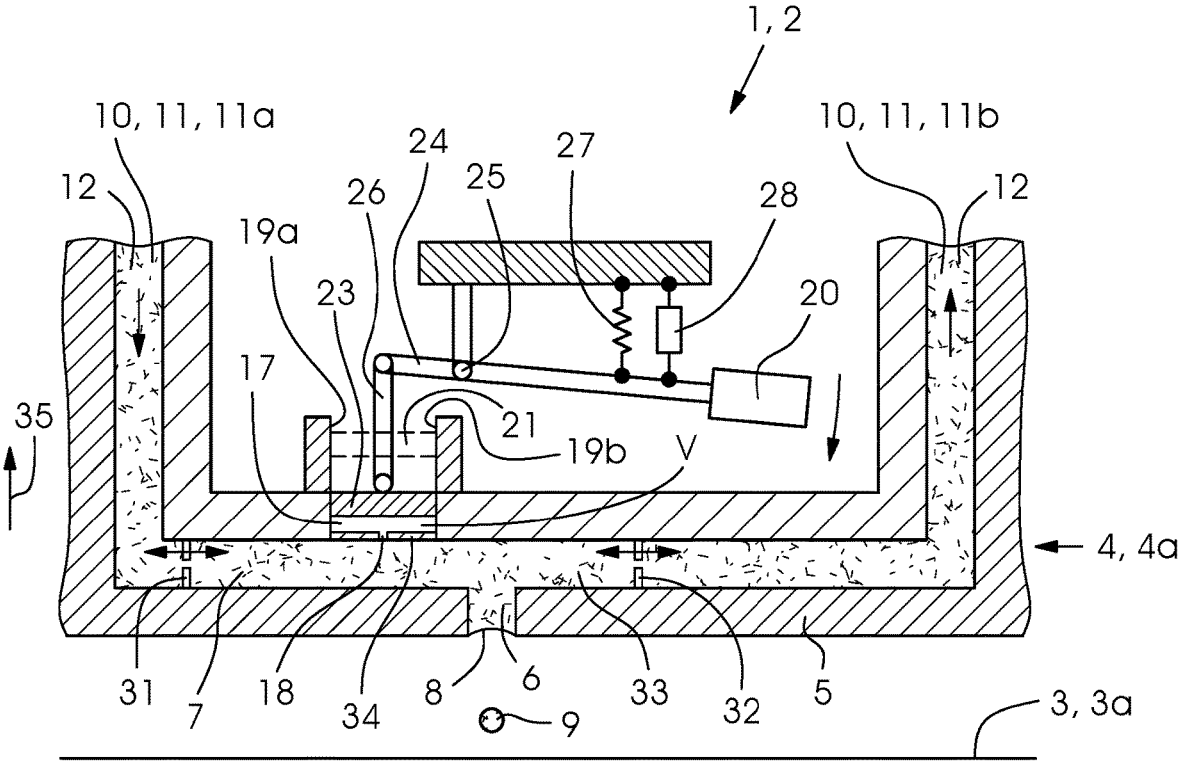
FIG. 2 is a fragmentary, sectional view of a preferred exemplary embodiment of a device according to the invention including a piston.

The chamber 17 among other elements is shown in FIG. 2. The chamber 17 has an opening 18 that connects the chamber to the ink line 11. Ink 7 may flow into and out of the chamber through the opening. In addition, the chamber has side walls 19*a* and 19*b* with a movable wall or a piston 23 disposed therebetween. The piston is also shown in an alternative position 21. When a joint movement 35 occurs, the piston is caused to move into this position 21 due to its mass inertia. For this purpose, the piston 23 is connected to a movable mass element 20 through a lever 24 (fixed for rotation about an axis 25) and a bar 26. In addition, a spring 27 and a damper 28 are provided to prevent the mass element from vibrating in an uncontrolled way. The mass of the mass element corresponds to the mass of the ink to be moved, i.e. it is between 100 and 200 g. If the ink volume is reduced or throttled, the mass of the mass element may likewise be reduced. As a result, the mass element may have smaller dimensions.

An infeed throttle 31 is provided in the ink line 11, 11*a* and a return throttle 32 is provided in the ink line 11, 11*b*. Both throttles are preferably adjustable, for instance by a sliding movement within the ink line. This is a way of adjusting a section 33 or a volume V thereof that is uncoupled from the rest of the circulation ink supply system. A throttle 34, preferably an adjustable throttle, may also be provided in the region of the opening 18. This throttle also acts as a damper (corresponding to the damper 28).

Figure 3:
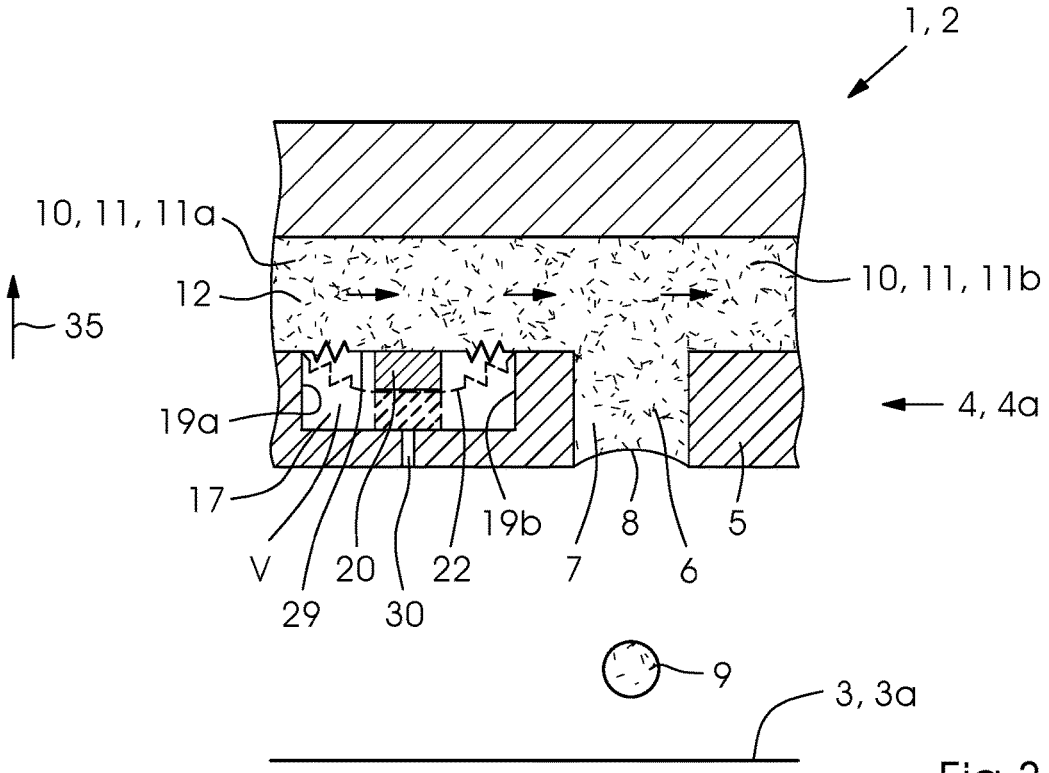
FIG. 3 is a fragmentary, sectional view of a preferred exemplary embodiment of a device according to the invention including a membrane.

FIG. 3 illustrates an alternative embodiment including a membrane 29 instead of the piston. The membrane borders the chamber 17 towards the ink line 11. The membrane is deformable. In the figure, the membrane is also shown in a second shape 22. The chamber is additionally provided with a vent hole 30. Again, due to inertia, the mass element 20 carries out a compensatory movement in terms of the joint movement 35. Due to the compensatory movement, the membrane is deformed and the volume V of the chamber changes.

The following is a summary list of reference numerals and the corresponding structure used in the above description of the invention:

1 device
2 machine
3 printing material
3*a* surface
3*b* defect/crease/wave
4 ink jet print head
4*a* first print head
4*b* further print head
4*c* last print head
4*d* print bar
5 nozzle surface
6 ink nozzles
7 ink
8 mensicus
9 ink drop
10 circulation ink supply system
11 ink line
11*a* feed line
11*b* return line
12 ink
13 feed line manifold
14 return line manifold
15 feed line pump
16 return line pump
17 chamber
18 opening
19*a, b* side walls
20 mass element
21 position
22 form
23 movable wall/piston
24 lever
25 axis
26 bar
27 spring
28 damper
29 wall/membrane
30 vent hole
31 feed line throttle
32 return line throttle
33 section
34 further throttle
35 movement/direction thereof
36 integrated unit
V chamber volume

The invention claimed is:

1. A device for printing ink onto a printing material, the device comprising:

an ink jet print head having a multiplicity of individually controllable ink nozzles for jetting ink drops;

a circulation ink supply system for said ink jet print head, said circulation ink supply system including an ink line to be filled with ink, said ink line including at least one of a feed line for supplying ink to or a return line for returning ink from said ink jet print head, said ink line including a feed line throttle and a return line throttle uncoupling a section of said ink line upstream and downstream of said ink jet print head from a remainder of said circulation ink supply system;

a chamber connected to said ink line;

said ink jet print head, said ink line and said chamber being configured to jointly carry out a movement relative to the printing material;

a mass element associated with said chamber, said mass element having at least one of a position or a shape being changeable relative to said chamber as a result of said joint movement; and said chamber having a volume being dependent on said position or said shape of said mass element to compensate for at least one of pressure fluctuations in the ink or movements of the ink.

2. The device according to claim 1, wherein said mass element is associated with a movable wall of said chamber or a movable piston in said chamber.

3. The device according to claim 2, which further comprises a lever connecting said mass element to said movable wall of said chamber or to said movable piston in said chamber.

4. A device for printing ink onto a printing material, the device comprising:

an ink jet print head having a multiplicity of individually controllable ink nozzles for jetting ink drops;

a circulation ink supply system for said ink jet print head, said circulation ink supply system including an ink line to be filled with ink, said ink line including at least one of a feed line for supplying ink to or a return line for returning ink from said ink jet print head;

a chamber connected to said ink line;

said ink jet print head, said ink line and said chamber being configured to jointly carry out a movement relative to the printing material;

a mass element associated with said chamber, said mass element having at least one of a position or a shape being changeable relative to said chamber as a result of said joint movement, said mass element associated with a movable wall of said chamber or a movable piston in said chamber;

a lever connecting said mass element to said movable wall of said chamber or to said movable piston in said chamber; and a spring and a damper associated with said piston or said lever;

said chamber having a volume being dependent on said position or said shape of said mass element to compensate for at least one of pressure fluctuations in the ink or movements of the ink.

5. The device according to claim 1, wherein said mass element forms a deformable membrane or is disposed on a deformable membrane, and said membrane forms a wall of said chamber.

6. The device according to claim 1, wherein said throttles are adjustable.

7. The device according to claim 1, wherein:

said ink jet print head is one of a plurality of ink jet print heads including a first ink jet print head and at least one further ink jet print head;

said ink line includes a feed line for said first ink jet print head and for said at least one further ink jet print head; and said chamber is connected to said ink line upstream of said first ink jet print head.

8. A device for printing ink onto a printing material, the device comprising:

an ink jet print head having a multiplicity of individually controllable ink nozzles for jetting ink drops;

a circulation ink supply system for said ink jet print head, said circulation ink supply system including an ink line to be filled with ink, said ink line including at least one of a feed line for supplying ink to or a return line for returning ink from said ink jet print head;

a chamber connected to said ink line;

said ink jet print head, said ink line and said chamber being configured to jointly carry out a movement relative to the printing material, said ink jet print head being one of a plurality of ink jet print heads including a last ink jet print head and at least one further ink jet print head;

said ink line forming a return line for said last ink jet print head and for said at least one further ink jet print head; and said chamber being connected to said ink line downstream of said last ink jet print head;

a mass element associated with said chamber, said mass element having at least one of a position or a shape being changeable relative to said chamber as a result of said joint movement; and said chamber having a volume being dependent on said position or said shape of said mass element to compensate for at least one of pressure fluctuations in the ink or movements of the ink.

9. A device for printing ink onto a printing material, the device comprising:

an ink jet print head having a multiplicity of individually controllable ink nozzles for jetting ink drops;

a circulation ink supply system for said ink jet print head, said circulation ink supply system including an ink line to be filled with ink, said ink line including at least one of a feed line for supplying ink to or a return line for returning ink from said ink jet print head;

a chamber connected to said ink line;

said ink jet print head, said ink line and said chamber being configured to jointly carry out a movement relative to the printing material;

said ink jet print head being stationary during problem-free printing operation; and said ink jet print head only carrying out said joint movement with said ink line and said chamber in a direction substantially perpendicular to a surface of the printing material in case of a problem;

a mass element associated with said chamber, said mass element having at least one of a position or a shape being changeable relative to said chamber as a result of said joint movement; and said chamber having a volume being dependent on said position or said shape of said mass element to compensate for at least one of pressure fluctuations in the ink or movements of the ink.

* * * * *